United States Patent [19]

Schmitz

[11] 4,304,520

[45] Dec. 8, 1981

[54] COMPOUND BOOM LATCH

[75] Inventor: Floyd A. Schmitz, Burlington, Iowa

[73] Assignee: J. I. Case Company, Racine, Wis.

[21] Appl. No.: 43,502

[22] Filed: May 29, 1979

[51] Int. Cl.[3] ..... B66F 9/00; E02F 3/00

[52] U.S. Cl. ..... 414/694; 414/680

[58] Field of Search ..... 414/694, 695, 680; 280/474; 403/321, 322, 325; 292/246, 263, 262, 265, 278

[56] References Cited

U.S. PATENT DOCUMENTS 3,811,582 5/1974 Schumaker et al. ..... 414/694

3,921,835 11/1975 Baker et al. ..... 414/694

FOREIGN PATENT DOCUMENTS 207174 6/1934 Australia ..... 292/265

*Primary Examiner*—Robert B. Reeves

*Assistant Examiner*—Douglas D. Watts

*Attorney, Agent, or Firm*—Dressler, Goldsmith, Shore, Sutker & Milnamow, Ltd.

[57] ABSTRACT

A combination of two pins and two lock rings are used to restrain the motion of a vehicle based boom having the ability to rotate in both the horizontal and vertical directions. Each lock ring is a plate like structure having a hole to receive the corresponding pin. One plate is attached to the boom; the corresponding pin is attached to the boom support. The second plate is attached to the vehicle body; the corresponding pin is attached to the boom support. A single control lever is provided so that the boom operator may actuate the lock rings and unlock each one in sequence.

4 Claims, 4 Drawing Figures

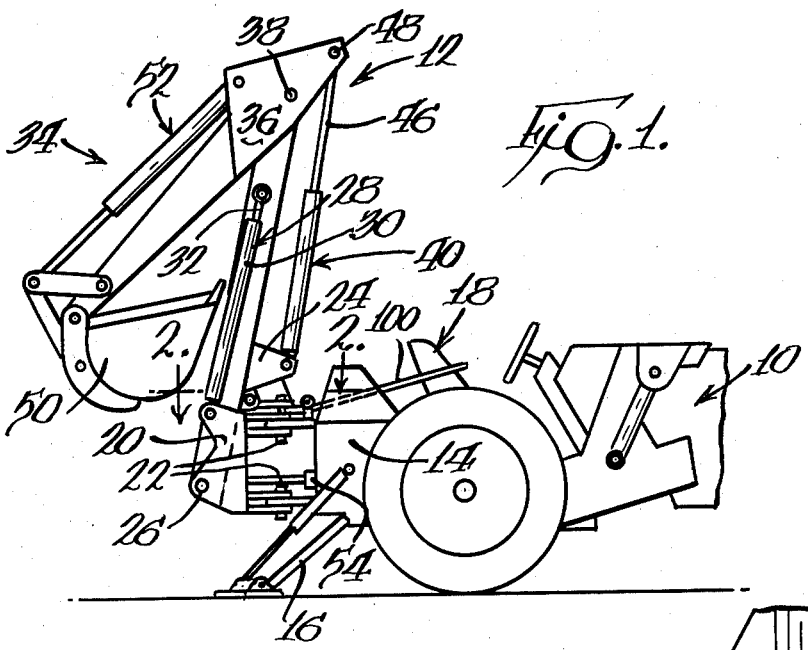
Fig. 1.
Fig. 2.
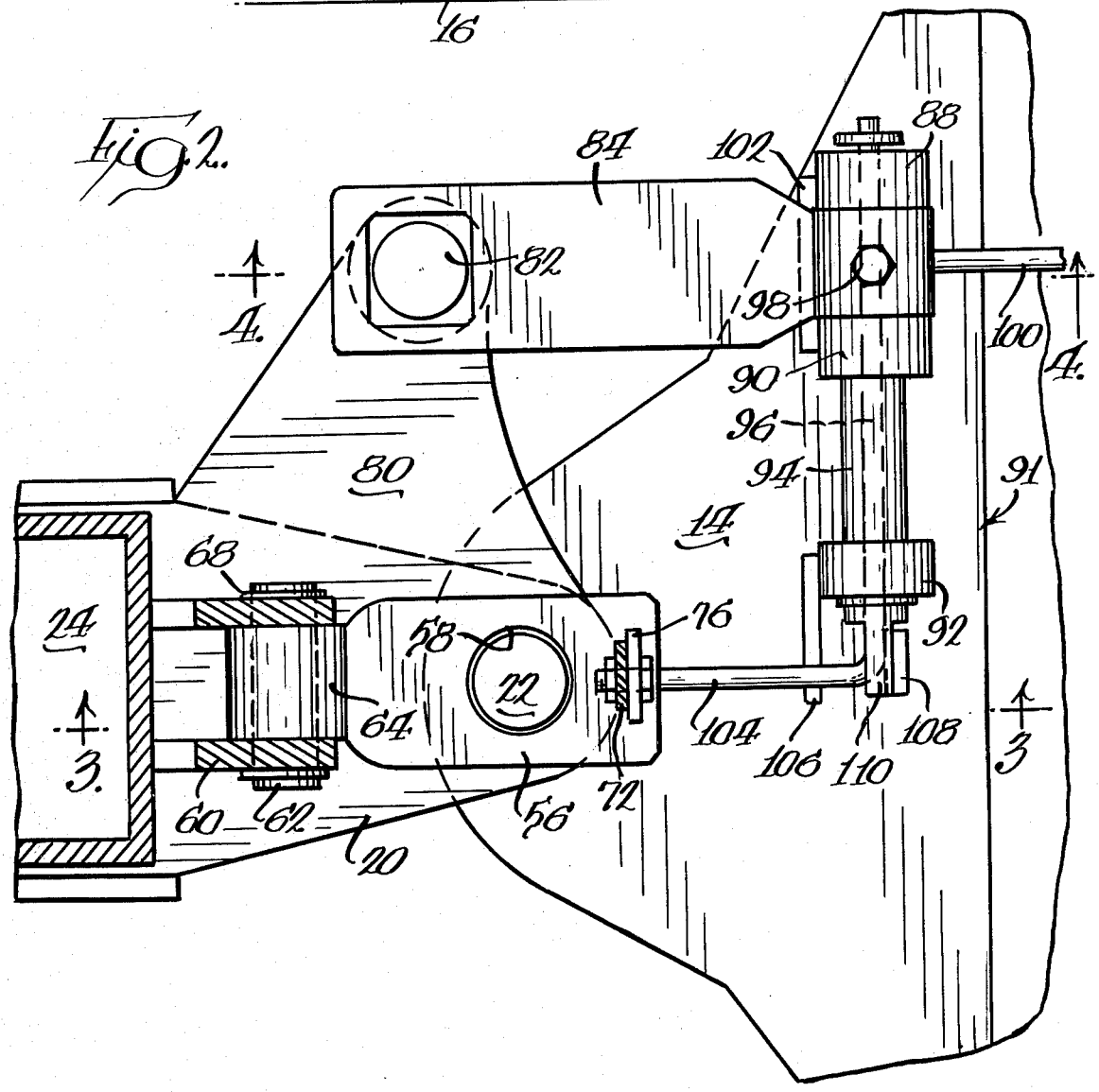

COMPOUND BOOM LATCH

TECHNICAL FIELD

An apparatus for locking and unlocking a boom and its supporting structure to the vehicle upon which they are carried to prevent motion of the boom about a horizontal and a vertical axis.

Most commercially available earthworking implements employ a boom that is pivoted on a boom support or swing tower which in turn is pivoted to a vehicle or base with a tool or bucket assembly pivoted on the free end of the boom. The boom and bucket assemblies are moved by fluid rams.

There are times when it is desirable to positively lock the boom and boom support without relying upon the fluid in the boom and boom support fluid rams (ex. hydraulic power plant maintenance, transportation with hydraulic fluid drained, etc.) In other instances it is desirable to hold the boom in the upright position to permit maximum utilization of fluid power for lifting and swinging payloads carried by the earthworking tool or bucket assembly.

It is also desirable to lock the boom to prevent it from swinging about a vertical axis. This is particularly true when the vehicle is travelling on public roads. When sharp turns at slow speed or normal turns at high speed are made abrupt swinging of the boom may result from the momentum of the boom and boom supported tool. This could jeopardize the stability of the vehicle and perhaps even overturn it. In addition, it is desirable to have the backhoe positively restrained since even slight movements of such a heavy mass could result in injury to personnel and damage to adjacent equipment.

BACKGROUND OF THE INVENTION

One locking device is described in U.S. Pat. No. 3,376,984 by Long and assigned to the assignee of the present invention. The disclosure of Long relates to what is referred to as an "over-center" boom, that is a boom which can be swung to a transport or storage position that is generally vertical and slightly toward the vehicle side of the boom support. In the Long patent, the boom is held in the transport position by the fluid rams that are used to pivot the boom about a horizontal axis on the boom support. The boom may be swung about a vertical axis by one or more hydraulic rams joining the boom support to the base. Similarly, the boom support may be restrained from swinging freely about its vertical axis during transportation or storage by forming a hydraulic lock in the fluid rams joining the boom support to the base.

Positive interlocks between the boom and the boom support are also disclosed in U.S. Pat. No. 3,811,582 by Shumaker and U.S. Pat. No. 3,921,835 by Baker both assigned to the assignee of the present invention. These latter disclosures do not provide for locking the boom support and thus do not completely lock the boom against rotation in two directions.

SUMMARY OF THE INVENTION

According to the present invention, a boom is positively locked to its support in a storage or transport position by utilizing a minimum number of parts and using where possible existing components that are already in use. A releasable lock means is utilized to lock the boom both horizontally and vertically. This device automatically locks the boom against rotating in a vertical plane when the boom is moved to the storage or transport position. After the boom support has been brought to the proper position for locking against further rotation in a horizontal plane, a second locking device is actuated by the equipment operator. These interlocks can be readily released in sequence or at the same time from the vehicle operator's control console by means of a single two position control lever.

More specifically, the releasable lock means consists of a first member that is carried by the boom and movable relative to it, a second member that is fixed to the vehicle, a third member that is fixed to the boom support and a fourth member that is attached to the vehicle and moveable relative to it.

The first member consists of a ring-like structure that is pivotally supported about a horizontal pivot axis on the boom and is biased by an elastomeric member to a first position. The advantage of utilizing an elastomeric member is that the member also holds the ring in a substantially fixed position during normal manipulation of the boom. The second member is the free end of a pin that is normally utilized for mounting the boom support to the base of the vehicle for pivotal movement about a vertical axis. Thus, the pin may be considered fixed relative to the boom support. The first and second members are located so that the first member engages and slides into the second member as the boom is pivoted about its horizontal axis towards the storage or transport position. This locks the first and second members together. A release means separates the first and second members by overcoming the biasing means.

When the boom is moved out of the vertical storage position, the biasing means returns the first member to the first position thereby automatically placing in a configuration for subsequent locking to the second member.

The third member is a pin fixed to the boom support structure and is offset from the pivot pin joining the boom support to the vehicle. The fourth member is a ring-like structure that is pivotally supported about a horizontal pivot axis on the vehicle base. When the third and fourth members are brought into alignment by manipulating the boom support, the equipment operation lowers the fourth member thereby locking the boom support to the vehicle base. To unlock the third and fourth members the equipment operator actuates the release means which raises the fourth member free from the third member. The same control that locks the two members together also is used to release the two members.

The release means for the third and fourth members also actuates the release means between the first and the second members. This is accomplished by a cam and follower to transmit motion from the control lever for the fourth member to the releasing device for the second member. In particular, the second member must be freed from the first member before the third and fourth members can be freed. The converse is also true; the first and second members are locked before the third and fourth members. Thus, the boom is first locked against rotation in a vertical plane and then locked against rotation in the horizontal plane.

To recapitulate, the boom is first locked to the boom support and then the boom support is locked to the vehicle. Using one control lever the vehicle operator first unlatches the boom support and then the boom thereby freeing the boom for movement.

BRIEF DESCRIPTION OF THE DRAWINGS

FIG. 1 is a fragmentary side view of a vehicle having an earthworking implement mounted thereon and having the present invention incorporated therein;

FIG. 2 is an enlarged fragmentary plan view showing the details in releasable lock means of the present invention as viewed along line 2—2 of FIG. 1;

DESCRIPTION OF THE PREFERRED EMBODIMENTS

Figure 3:
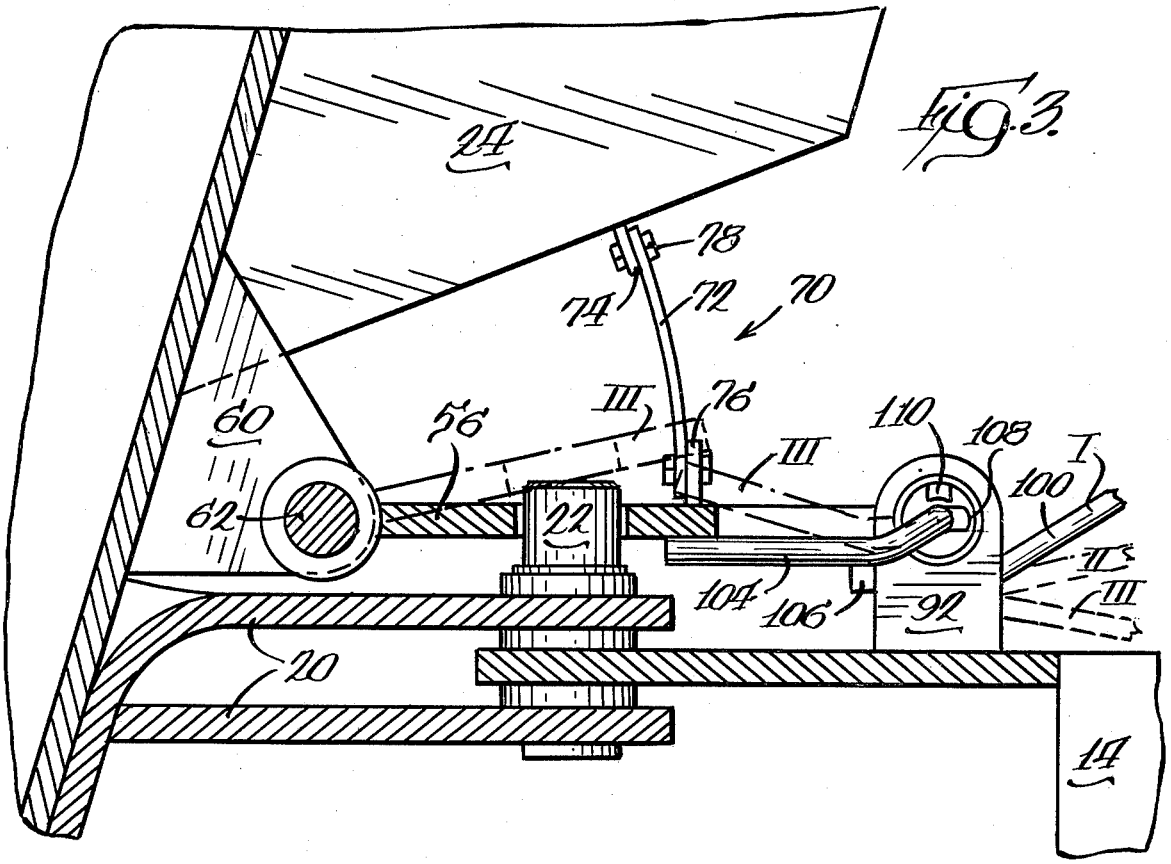
FIG. 3 is an enlarged fragmentary elevation view of the releasable lock means as viewed along line 3—3 of FIG. 2.

While this invention is susceptible to embodiment in many different forms, there is shown in the drawings and will herein be described in detail an embodiment with the understanding that the present disclosure is to be considered as an exemplification of the principles of the invention and is not intended to limit the invention to the embodiment illustrated.

FIG. 1 of the drawing shows a vehicle generally designated by reference numeral 10, having an earthworking tool or implement 12 supported thereon. The implement 12 consists of a backhoe which includes a frame 14 having outriggers 16 supported thereon with the frame being attached to the end of the vehicle, adjacent an operator's station 18. The operator's station 18 may be part of the vehicle or may be a separate area on the frame 14.

A swing tower or boom support 20 is pivoted about a vertical axis defined by two vertical pivot pins 22, which will be described in more detail later, while a boom 24 is supported at its lower end by horizontal pivot pins 26 on the boom support or swing tower 20. The boom 24 is pivoted about a horizontal pivot axis (defined by the horizontal pivot pins 26) by a pair of boom fluid rams 28 (only one being shown) located on opposite sides of the boom 24 with the cylinder 30 of the ram secured to the boom support 20 and the piston rod 32 secured to the boom 24.

A dipper stick assembly 34 is supported on the other end of said boom; it includes a member 36 pivoted intermediate its ends on the free end of the boom 24 by pivot pin 38. Movement of the member 36 is controlled by a dipper stick fluid ram 40 having its cylinder 42 pivotally supported on the boom adjacent to the boom support 20 with its piston rod 46 pivotally supported on one end of the member 36 by pin 48. A bucket 50 is pivoted on the opposite or outer end of dipper stick by an additional fluid ram 52. Finally, other fluid rams 54 are used to pivot the boom support about the vertical axis.

It is generally true in vehicles of this type that the boom 24 is connected to the boom support structure 20 and pivots about it in a vertical plane. The boom support structure 20 is in turn attached to the vehicle frame 14 so that the boom support structure pivots in a horizontal plane. The pivot pin 22 joining the boom support structure to the vehicle frame 14 may be attached to either the boom support structure 20 or the vehicle frame 14. Consequently, two locks are necessary to completely restrain the motion of the boom.

For purposes of identification, the two locks will be referred to as the "vertical lock" and the "horizontal lock." The vertical lock prevents vertical motion or motion of the boom in a vertical plane. Similarly, the horizontal lock prevents motion of the boom and its support in a horizontal plane. Collectively the locks are referred to as "the releasable lock means."

The so-called vertical lock closely resembles and follows the teachings of the Baker patent previously identified and is herein incorporated by reference.

During normal operation of the earthworking implement, the boom is maintained rearwardly (FIG. 1) or to the left of the vertical axis previously defined. The boom, dipper stick and bucket are manipulated by applying pressurized fluid to the fluid rams 28, 40, 52 and 54. When it is desired to move the implement to its transport or storage position, the boom fluid rams 28 are manipulated in such a manner that the boom is moved to the vehicle side of the vertical axis. This manner of moving a boom to its transport position is explained in greater detail in the Long patent which is incorporated herein by reference.

According to the present invention, the boom and support carry a releasable lock means to lock the boom to the boom support and lock the boom support to the vehicle when the boom is moved to the transport or storage position. Referring to FIG. 2, the vertical lock portion of the releasable lock means includes a first member or vertical lock ring structure 56 that has an opening 58 for receiving a pin or second member 22. The first member 56 is supported for movement by a pair of ears 60 that form part of the boom 24 and a horizontal pin 62 received through a bushing 64 that is fixedly secured by snap rings 68 and forms part of the first member, the ring-like structure or locking plate 56.

Referring to FIG. 3, the first member 56 is normally biased to a first position by biasing means 70 interposed between the boom 24 and the first member 56 which accommodates movement of the first member from the first position. Preferably the biasing means is in the form of an elastomeric or rubber member 72 that has one end connected to a bracket 74 carried by the boom and the opposite end connected to a bracket 76 on the first member 56. The bias means is shown attached to the boom and first member by metal fasteners 78.

Figure 4:
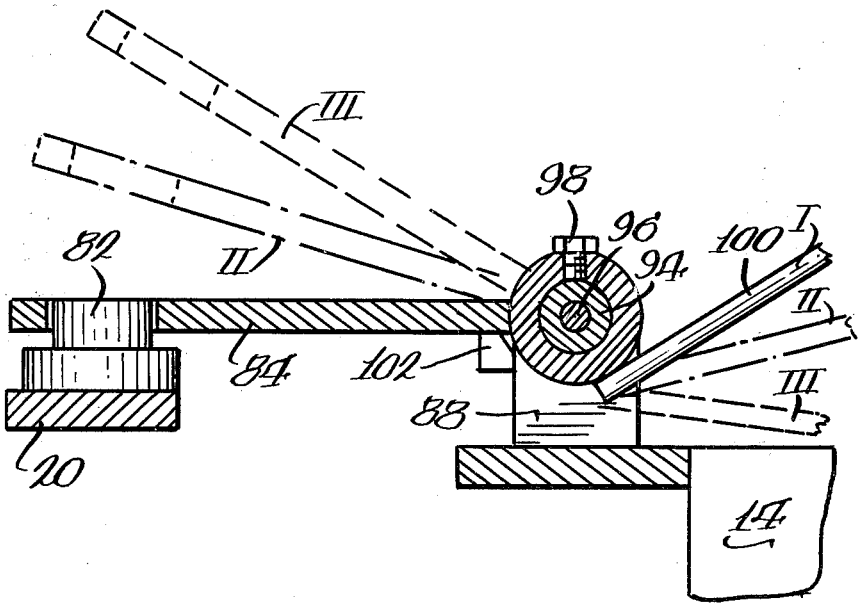
FIG. 4 is a further fragmentary elevation view of the releasable lock means, as viewed along line 4—4 of FIG. 2.

The horizontal lock portion of the releasable lock means is shown in FIGS. 2 and 4. It includes a lock pin or third element 82 attached to an extension 80 of the boom support 20 and a horizontal lock ring structure or fourth element 84 attached to the vehicle or base 14. The lock pin 82 is offset from the pivot pin 22 of the boom support 20. The horizontal lock ring 84 is pivoted about a horizontal axis 86 defined by two brackets 88 and 90 attached to the vehicle.

Both the horizontal and vertical locks are released by a release means 91. One portion of the release means releases the horizontal lock and is referred to as the "horizontal release means," while another portion releases the vertical lock and is referred to as the "vertical release means." The release means 91 consists of three spaced brackets 88, 90, and 92 attached to the vehicle frame 14 and two concentric shafts; an outer shaft 94 and an inner shaft 96. Horizontal lock ring 84 is attached to the outer shaft 94 by a lock screw 98, and an operating lever 100 is attached to the lock ring 84, and extends to the operator's station 18. The horizontal lock ring 84 is restrained against counterclockwise rotation by a stop 102. Thus, manipulation of the operating lever 100, as shown in FIG. 4, rotates the outer shaft 94 and raises the horizontal lock ring 84.

Referring to FIG. 3, as the operating lever 100 rotates outer shaft 94, motion is induced to the vertical release means to release the vertical lock. The vertical lock unlocking means includes a trip lever 104 which is an offset portion of the inner shaft 96. This lever has a stop 106 to limit counterclockwise rotation of the trip lever. Fixedly attached to the inner shaft 96 is a follower 108 and fixedly attached to the outer shaft 94 is a cam 110 (shown integrally attached to one end of the outer shaft in FIG. 2).

Successive positions of the operating lever 100 are identified by Roman Numerals I, II and III. With the operating lever in the first position (I) the horizontal lock ring is indexed upon the lock pin 82, thereby locking the boom support to the vehicle frame 14. As the outer shaft is moved to the next position (II) by operating lever 100 the horizontal lock ring is lifted free of the lock pin 82, thereby allowing the boom support structure to rotate in a horizontal plane.

In moving to this position, the cam 110 on the outer shaft 94 comes into contact with the follower 108 on the inner shaft. Rotation of the operating lever 100 to a third position (III) further raises the horizontal lock ring 84 and at the same time lifts trip lever 104 by virtue of cam 110 engaging follower 108. This overcomes the biasing means and lifts the vertical lock ring 56 free from its first or locked position to an unlocked position (shown by dotted lines in FIG. 3).

Once the boom is unlocked in both the vertical and horizontal planes, the operator may return the operating lever 100 from the third position (III) to the second position (II). If left in second position (II), the boom is ready to be automatically locked in the vertical plane; while the horizontal lock ring remains clear of the horizontal lock pin 82. Once the boom is locked vertically, the control lever may then be placed to the first position (I) when the horizontal lock pin 82 on the boom support is in proper alignment with the horizontal lock ring 84. When the operating lever is in this position (I), the boom is locked in both the horizontal and vertical directions.

The operation of the releasable lock means will now be reviewed. To lock the boom, the boom 24 is pivoted to a storage position (FIG. 1). When the pin 22 defining the vertical pivot axis of the boom is in alignment with the vertical lock ring or first member 56, the lower surface of the vertical locking ring is just slightly above the free end of the vertical pivot pin 22. As opening 58 becomes in general vertical alignment with pin 22, the opening surrounds the pin to provide a lock between the boom and the boom support. This will hold the boom in the transport position with respect to the boom support 20. After alignment of the horizontal lock pin 82 to the horizontal lock ring 84 the horizontal locking ring may be lowered by actuation of operating lever 100. Thus the boom is locked in both the horizontal and vertical directions.

To release the boom from the support for pivotal movement thereto, it is only necessary for the equipment operator to rotate operating lever 100 to raise both locking rings free from the lock pins.

As can be appreciated from the above description the releasable lock means between the boom and support be incorporated into any existing machine with a minimum amount of modification and with ordinary parts. While the particular interlock means and its operation has been shown and described in connection with the overcenter type boom, the same arrangement can be incorporated into a boom structure wherein the boom never travels across the top of the boom support.

What is claimed is:

1. In an implement having: a boom support pivoted about a vertical axis on a base between a storage position and at least one working position, with said vertical axis defined by at least one pivot pin; a boom pivoted about a horizontal pivot axis on said boom support between a transport position and at least one extended position; and a vertical lock means, between said boom and said boom support, for releasably locking said boom in its transport position relative to said boom support, a horizontal lock mechanism for releasably locking said boom support and said base together comprising:

(a) a vertical pin attached to said boom support;

(b) a locking plate pivoted on said base and having an opening within its confines for receiving said vertical pin, said vertical pin and locking plate being positioned relative to each other such that said vertical pin and said locking plate are aligned together when said boom support is pivoted to its storage position, whereby the engagement of said vertical pin and said locking plate locks together the boom support and the base; and (c) release means, carried by the base, for separating said locking plate from said vertical pin and releasing said vertical lock means between said boom and said boom support, said release means including single control means for initially separating said locking plate and vertical pin and subsequently releasing said vertical lock means.

2. In an implement having a boom support pivoted about a vertical axis on a base between a storage position and at least one working position, with said vertical axis defined by at least one pivot pin, and a boom pivoted about a horizontal pivot axis on said boom support between a transport position and at least one extended position, a compound lock comprising:

(a) vertical lock means, between said boom and said boom support, for releasably locking said boom in its transport position relative to said boom support, said vertical lock means including:

a first element defined by the upper free end portion of said at least one pivot pin;

a second element, free to pivot on said boom about a horizontal axis between a first and a second position, defining an opening within its confines for receiving said first element, said first and second elements being positioned relative to each other so that pivotal movement of said boom to its transport position aligns said opening with said one pin; and biasing means, carried by said boom, for normally maintaining said second element in its first position and accommodating movement from said first position to said second position, whereby pivoting the boom to its transport position engages the first and second elements with the biasing means holding the first and second elements together; and (b) a horizontal lock between said boom support and said base having:

a vertical pin attached to said boom support;

a locking plate, pivoted on said base and having an opening with its confines, for receiving said vertical pin, said vertical pin and locking plate being positioned relative to each other such that said vertical pin and said locking plate are aligned together when said boom support is pivoted to its storage position, whereby the engagement of said vertical pin and said locking plate locks together the boom support and the base; and release means, carried by the base, for separating said locking plate from said vertical pin and said first element from said second element, said release means including a lever rotatably supported about a horizontal pivot axis adjacent to said base for sequentially rotating said locking plate free from said vertical pin and said second element from its second position, whereby said boom is free to rotate about a horizontal axis and a vertical axis.

3. A locking device for earthworking equipment having a boom pivoted about a boom support structure for pivotal movement in a vertical plane, and a boom support structure pivoting about a vehicle in a horizontal plane, comprising:

a pivot pin for pivoting the boom support to said vehicle;

a first locking plate, pivoted at one of its edges to said boom about a horizontal axis between a first position and an unlocked position;

an elastomeric member, between said plate and boom, for normally maintaining said plate in a first position, said plate having an opening such that when the boom is placed in its first position, said plate and said pin come together precluding relative motion between said boom and said boom support structure;

a lock pin attached to the boom support structure and offset from the vertical axis of rotation said boom support structure;

a second locking plate pivoted about the horizontal axis and attached to said vehicle, said plate having an opening to accommodate said lock pin on said boom support, whereby upon indexing said plate on said lock pin, said boom support structure is locked to said vehicle so as to prevent rotation about a vertical axis; and lock release means, carried by said vehicle, for separating said first and second locking plates from the associated pivot and lock pins to allow free movement of said boom in both the horizontal and vertical planes, said lock release means including:

(a) a generally horizontal shaft attached to said second locking plate;

(b) a control lever attached to said shaft to rotate said shaft and said second locking plate;

(c) a lever arm disposed to rotate about a horizontal axis to raise said first locking plate; and (d) a cam rotated by said shaft to transmit rotation to said lever arm, whereby said lever arm is rotated after said second locking plate has been raised clear of said lock pin and said second locking plate may be lowered after lowering said lever arm.

4. A releasable locking device for a boom support structure pivoted to a vehicle base having a boom pivoted to said boom support and locked to said boom support by a boom lock, comprising:

a lock pin attached to the boom support structure and offset from the vertical axis of rotation of said boom support structure;

a locking plate pivoted about a horizontal axis and attached to said vehicle, said plate having an opening to accommodate said lock pin on said boom support, whereby upon indexing said plate on said lock pin, said boom support structure is locked to said vehicle to prevent rotation about said vertical axis; and lock release means, carried by the vehicle, for separating said locking plate from said pin to allow free movement of said boom support in the horizontal plane, said lock release means including:

(a) a shaft attached to said locking plate;

(b) a control lever attached to said shaft to rotate said shaft and said locking plate about a generally horizontal axis;

(c) cam means rotated by said shaft for transmitting rotation to said boom lock, whereby said locking plate can be lifted free from said pin by the operation of said control lever.

* * * * *